US005299429A

United States Patent [19]

Swink

[11] Patent Number: 5,299,429

[45] Date of Patent: Apr. 5, 1994

[54] PORTABLE CONDENSING FAN

[76] Inventor: David Swink, 1016 Illinois, Borger, Tex. 79007

[21] Appl. No.: 33,039

[22] Filed: Mar. 18, 1993

[51] Int. Cl.[5] ..... F25D 17/06

[52] U.S. Cl. ..... 62/89; 62/507; 62/DIG. 7

[58] Field of Search ..... 62/DIG. 17, 89, 507, 62/184, 508, 177, 181, 186

[56] References Cited

U.S. PATENT DOCUMENTS

| | | | |
|---|---|---|---|
| 2,920,464 | 1/1960 | Trask | 62/507 |
| 3,934,425 | 1/1976 | Morris | 62/DIG. 17 |
| 4,043,708 | 8/1977 | Greenfield | 62/507 |

*Primary Examiner*—John M. Sollecito
*Attorney, Agent, or Firm*—Johnson & Gibbs

[57] ABSTRACT

A temporary air conditioning condensing fan is mounted in a rigid housing which may be easily and rapidly mounted at the air exhaust side of an air conditioning unit to provide a temporary flow of cooling air to the condenser, in the event the existing condensing fan fails. A portion of the housing forms a shroud around the temporary condensing fan and directs the flow of air over the condenser. A head pressure adjusting valve adapts the temporary condensing fan to differently sized air conditioning units and maintains an efficient head pressure on the condenser of the existing air conditioning unit.

16 Claims, 3 Drawing Sheets

PORTABLE CONDENSING FAN

BACKGROUND OF THE INVENTION

1. Field of the Invention

The invention relates to air conditioning condensing fans and, more particularly, to a fan and housing which temporarily replace an existing condensing fan in an air conditioning unit.

2. History of the Prior Art

Air conditioning units operate on the principle known as the refrigeration cycle. In a closed-loop air conditioning system, a coolant is circulated through a series of pipes and heat exchangers, from which no coolant escapes, and eventually returns to its starting point. The coolant starts the cycle in a liquid state and travels to a heat exchanger where heat energy from the space to be cooled is absorbed by the coolant. The added heat vaporizes the coolant which then enters a condenser in the air conditioning unit.

Air conditioning units rely on condensers to condense coolant in the air conditioning system from a gaseous state to a liquid state, after the coolant has absorbed heat energy from the volume being cooled. In order to achieve this condensation, condensers utilize condensing fans to draw or blow cooling air over a set of condensing coils which contain the coolant. As the coolant travels through the coils, its heat is conducted through the coils where it is carried away by the flow of air created by the condensing fan.

The condenser and condensing fan are generally located outdoors where the heat can be dissipated into the surrounding atmosphere. In the summertime, air conditioners are operated for many hours per day, and condensing fans must operate in very high ambient temperatures. This environment is very strenuous on electric motors, and the failure of condensing fans is a common source of air conditioning outages in both residential and commercial air conditioning units.

The only economically viable solution for a failed condenser fan is to replace the fan. Air conditioning service technicians must obtain a new fan, either from stock or from a supplier, transport it to the air conditioner site, and remove and replace the failed fan.

There are many different types, sizes, and brands of condensing fan motors, and the technician must replace the failed fan with a condensing fan which is compatible with the customer's particular air conditioning unit and mounting frames. However, due to the size of a typical condensing fan, a technician cannot stock many fans on his service truck. It is very difficult for a service technician to carry even the most commonly used condensing fans, and he almost never carries the rarer types. Therefore, when a rare type of condensing fan fails, it is highly likely that the service technician will not have a replacement fan on his truck. As a consequence, the air conditioning unit is without cooling air, and out of service until a replacement fan can be obtained.

In larger cities, where air conditioning supplies are plentiful, the technician may be able to obtain a replacement fan within a few hours. In smaller towns and in rural areas, where supplies are not as plentiful, the problem is much worse; it may take several days to obtain the proper fan, and the customer is without air conditioning for that entire period. Additionally, it may take days to obtain rarer types of condensing fans no matter where the unit is located.

In order to reduce this delay, many air conditioning technicians maintain a large inventory of condensing fans in their shops. This adds to their cost of doing business since some fans may sit on the shelf for years before they are needed.

Additional cost and delay is experienced in checking out the air conditioning system when the service technician finally replaces the condensing fan after a lengthy outage. Long delays in resuming air conditioning allow the temperature in the air-conditioned space to rise significantly. When the temperature in the space to be cooled is hot, the coolant absorbs a greater amount of heat energy, vaporizes more completely, and rises to a higher temperature and pressure. As a consequence, the temperature and pressure inside the condenser run higher than normal. The technician must wait for the condenser pressure to return to the normal range to complete the check-out of the system. The pressure in the condenser does not return to normal until the temperature in the space to be cooled returns to its normal range. This causes additional delay to the technician and expense to the customer.

It would be a distinct advantage for air conditioning service technicians to have a temporary condensing fan which can be used to temporarily provide a cooling of air to an air conditioning condenser when its existing fan fails. Moreover, it would be advantageous to have this portable condensing fan mounted in a housing which may be compatibly mounted on any brand of air conditioner unit. It would also be advantageous to have the fan easily and quickly mounted and wired into the air conditioner system, and to have an adjustable air flow in order to adjust the condenser's head pressure so that the refrigeration cycle could work as efficiently as possible.

The portable condensing fan of the present invention offers such a fan. The portable condensing fan of the present invention temporarily supplies cooling air, and enables the customer to remain in air conditioned comfort, until a permanent replacement fan is obtained and installed. The air temperature, therefore, remains cool in the air conditioned space, thereby maintaining the condenser pressure in its normal range, and greatly reducing the time for system check-out, following final replacement of the condensing fan.

Additionally, the portable condensing fan of the present invention lowers the cost of air conditioning services by allowing technicians, to reduce their inventory. By carrying one portable condensing fan, a service technician significantly lowers his required inventory of condensing fans, while providing better service to his customers.

SUMMARY OF THE INVENTION

In one aspect, the present invention is a portable condensing fan for temporarily cooling a condenser of an air conditioning unit. The portable condensing fan comprises a means for passing a flow of air over the condenser of the air conditioning unit, and a means for mounting the means for passing a flow of air on the exterior surface of the air exhaust side of the air conditioning unit. The means for passing a flow of air over the condenser includes an electric heating/ventilating air conditioning motor and a fan blade attached to the motor. The means for mounting the portable condensing fan at the air exhaust side of the air conditioning unit includes a rigid housing for mounting the motor and fan blade therein, and anchoring members for securing the housing to the exhaust side of the air conditioning unit.

In another aspect, the present invention is a method of temporarily cooling a condenser of an air conditioning unit having an air exhaust side. The method comprises the steps of mounting a portable condensing fan on the exterior surface of the air exhaust side of the air conditioning unit, and passing a flow of air over the condenser of the air conditioning unit. The step of mounting the portable condensing fan at the air exhaust side of the air conditioning unit includes mounting a portable condensing fan within a rigid housing, and anchoring the housing to the exhaust side of the air conditioning unit. The step of passing a flow of air over the condenser includes providing a fan which has an electric motor and a fan blade attached to the motor.

BRIEF DESCRIPTION OF THE DRAWING

The invention will be better understood and its numerous objects and advantages will become more apparent to those skilled in the art by reference to the following drawing, in conjunction with the accompanying specification, in which.

DETAILED DESCRIPTION

Figure 1:
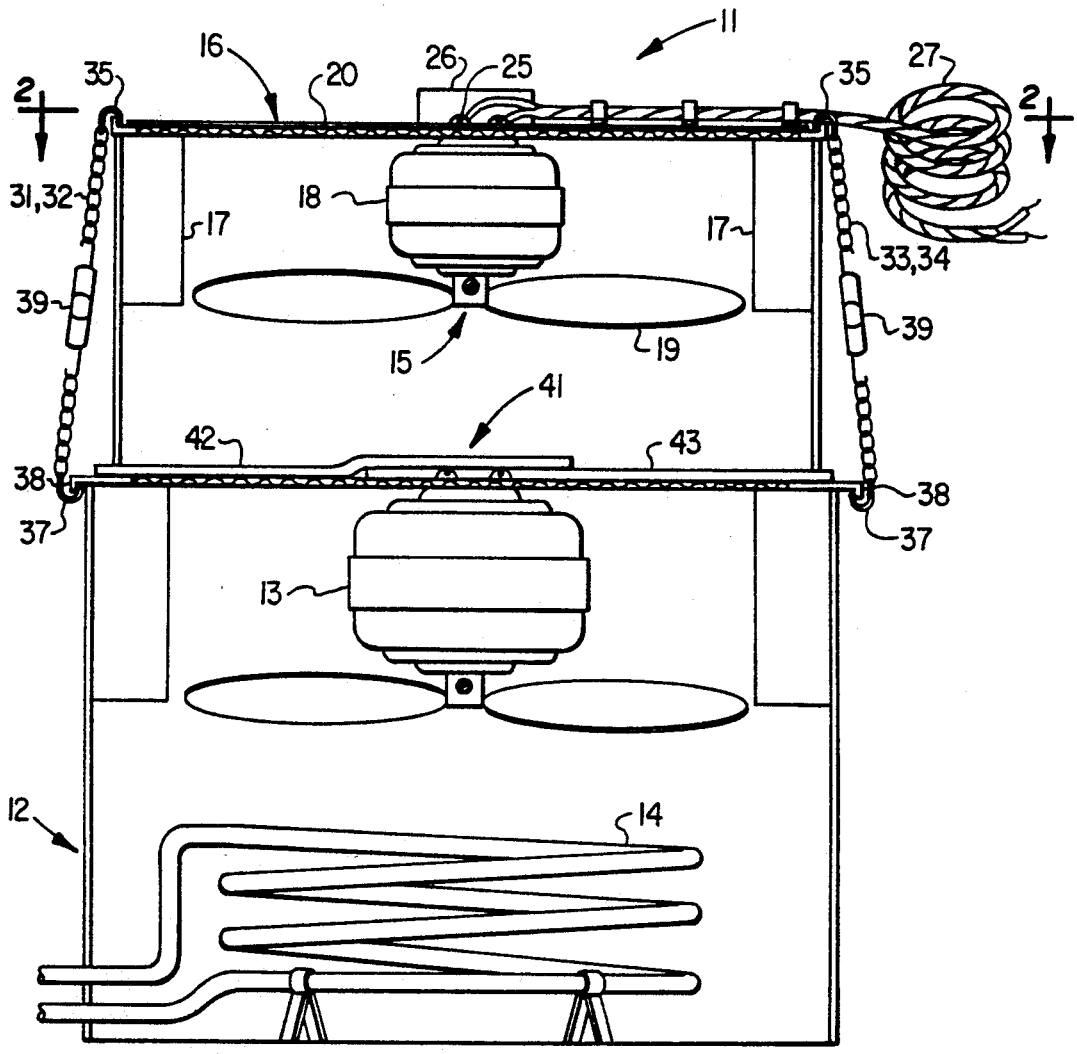
FIG. 1 is a sectional, side elevational view of a portable condensing fan and housing, constructed in accordance with the teachings of the present invention, and mounted on top of a representative air conditioning unit.

FIG. 1 is a cut-away, side elevational view of a temporary condensing fan (PCF) 11 constructed in accordance with the teachings of the present invention, and mounted on top of a representative air conditioning unit 12. The portable condensing fan of the present invention may be used to temporarily replace a faulty condensing fan 13 in the air conditioning unit 12 until, a permanent replacement fan can be installed. The PCF 11 is mounted at the air discharge side of the air conditioner's condenser 14. In cases where a replacement fan cannot be found, the PCF 11 may be permanently mounted on the air conditioning unit 12.

In the preferred embodiment of the PCF of the present invention, a fan 15 is mounted inside a rigid housing 16 which provides a means for mounting the fan 15 as well as providing a shroud 17 to properly direct the flow of air through the condenser 14 of the air conditioning unit 12. The housing 16 may be constructed of sheet metal or any other rigid, weatherproof material. The top of the housing 16 is covered by a protective screen 20.

The fan 15 may comprise an electric motor 18 and a set of fan blades 19. The electric motor 18 may be a ½ horse power, heating/ventilating air conditioning (H.V.A.C.) motor which operates at 900 R.P.M. and pushes a nominal 5,940 cubic feet of air per minute. The set of fan blades 19 may be a 4-blade set having a diameter of 22 inches, and a blade pitch of 35 degrees. A wiring box 26 may contain a capacitor (not shown) and a wiring harness 27 for quick wiring of the PCF 11 to connectors (not shown) on the existing air conditioning unit 12.

Figure 2:
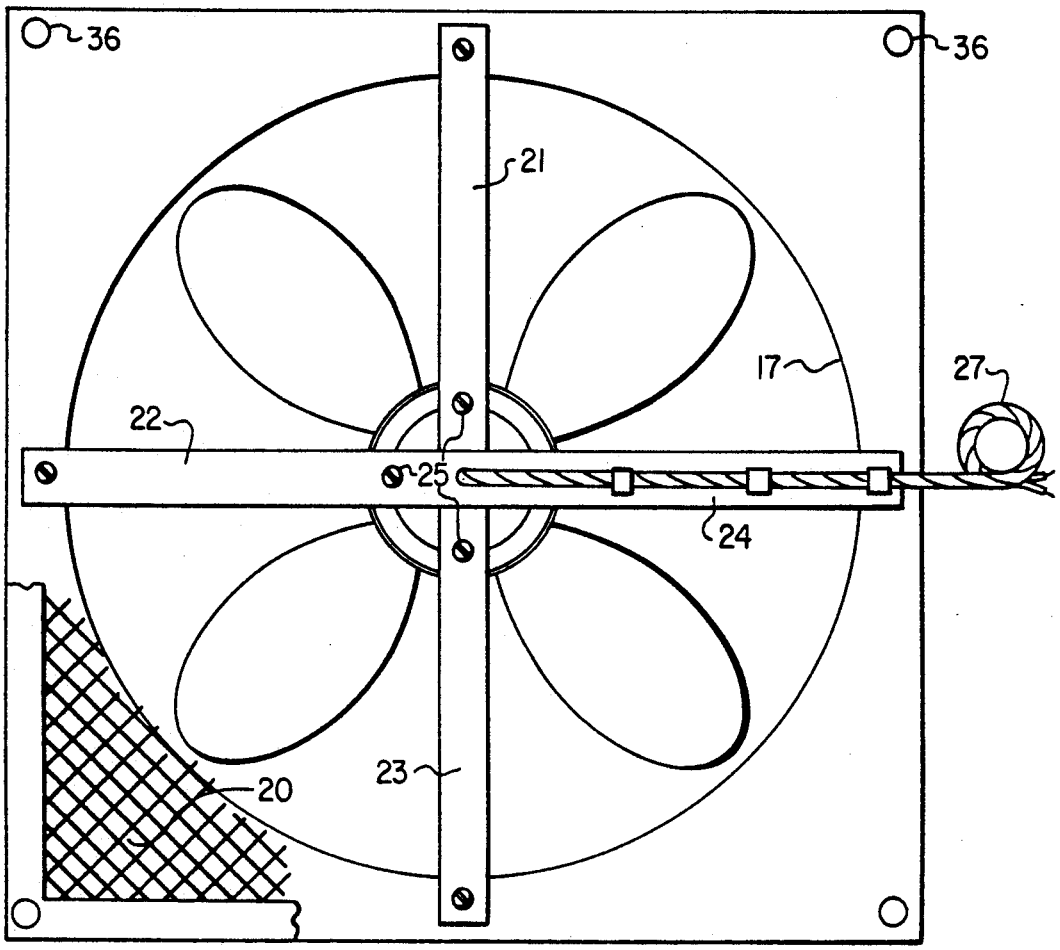
FIG. 2 is a top side view of a portable condensing fan and housing, with a part of the protective screen broken away to reveal a horizontal section taken along the line 2—2 of FIG. 1.

FIG. 2 is a top side view of the portable condensing fan 11 and housing 16, with a part of the protective screen broken away to reveal a horizontal section taken along the line 2—2 of FIG. The housing 16, as noted above, is the main frame in which the PCF 11 is mounted. The TCF 11 is mounted to the top side of the housing 16 using brackets 21-24 and screws 25.

The housing 16 may be quickly fastened to the air conditioning unit 12 using a quick fastening system utilizing anchoring members 31-34, which may be chains. The anchoring members 31-34 are equipped with upper hooks 35 for engaging holes 36 at each corner of the top surface of the housing 16 (FIG. 2). The anchoring members 31-34 are also equipped with lower hooks 37 for engaging a sheet metal lip 38 of the air conditioning unit 12. Each anchoring member 31-34 is also equipped with a turnbuckle 39 which may be rotated to reduce the length of the anchoring members 31-34, thereby securely and quickly mounting the PCF 11 on the air conditioning unit 12. Alternatively, for use of very short duration, the anchoring members 31-34 may be constructed of elastic material such as rubber, "bungie" cords, or springs.

Figure 3:
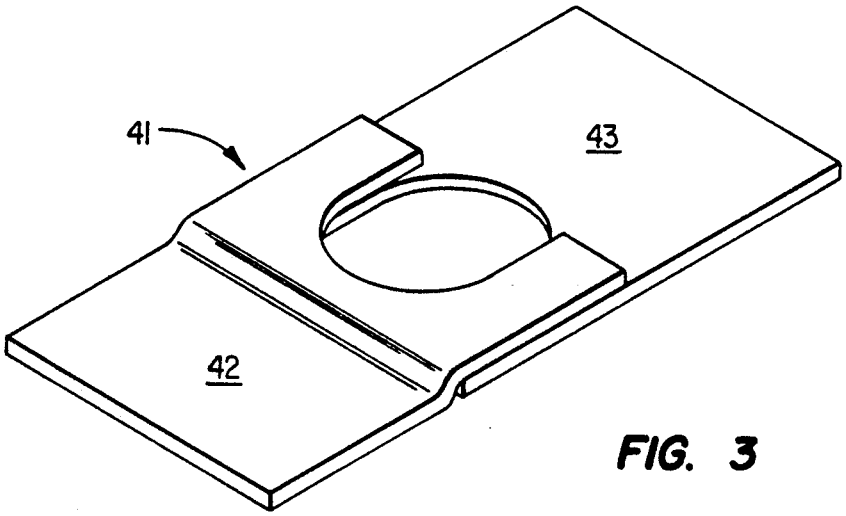
FIG. 3 is a perspective view of a head pressure adjusting valve having two valve sections in the fully closed position.

The PCF of the present invention is also equipped with a head pressure adjusting valve 41, positioned between the PCF 11 and the existing air conditioning unit 12. The head pressure adjusting valve 41 may be adjusted to maintain an efficient head pressure on the condenser 14 throughout a range of condenser sizes in various air conditioning units. FIG. 3 is a perspective view of the head pressure adjusting valve 41 having two valve sections 42 and 43 in the fully closed position. As seen in FIG. 3, the head pressure adjusting valve 41 may be of the guillotine type. Two valve sections 42 and 43 may be slid in relation to each other to form a varyingly sized opening therebetween. In the preferred embodiment, the valve sections 42 and 43 may be constructed of an elastomeric material such as, for example 1/64-inch neoprene rubber.

Figure 4:
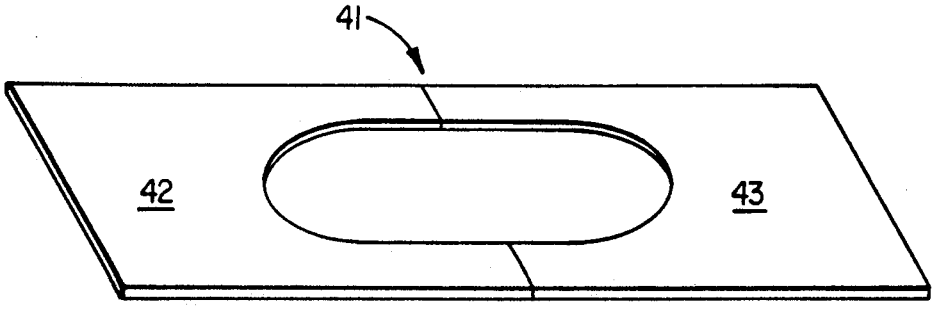
FIG. 4 is a perspective view of a head pressure adjusting valve having two valve sections in the fully open position.

FIG. 4 is a perspective view of a head pressure adjusting valve 41 having two valve sections 42 and 43 in the fully open position.

In operation, the service technician places the valve sections 42 and 43 on top of the existing air conditioning unit 12, and adjusts the size of the opening between the valve sections as appropriate for that particular air conditioning unit 12. The housing 16 of the PCF 11 is placed on top of the valve sections 42 and 43, which may, or may not, be overlapped, as shown in FIGS. 3 and 4. The technician then anchors the PCF 11 to the existing air conditioning unit 12 using the anchoring members 31-34. As the turnbuckles 39 are tightened, the head pressure adjusting valve 41 is compressed between the housing 16 and the existing air conditioning unit 12, forming a vibration buffer and seal therebetween. The technician may then quickly connect the wiring harness 27 to the electrical connectors of the existing air conditioning unit 12, and the PCF 11 is ready for operation as a temporary replacement of the failed condensing fan 13.

Figure 5:
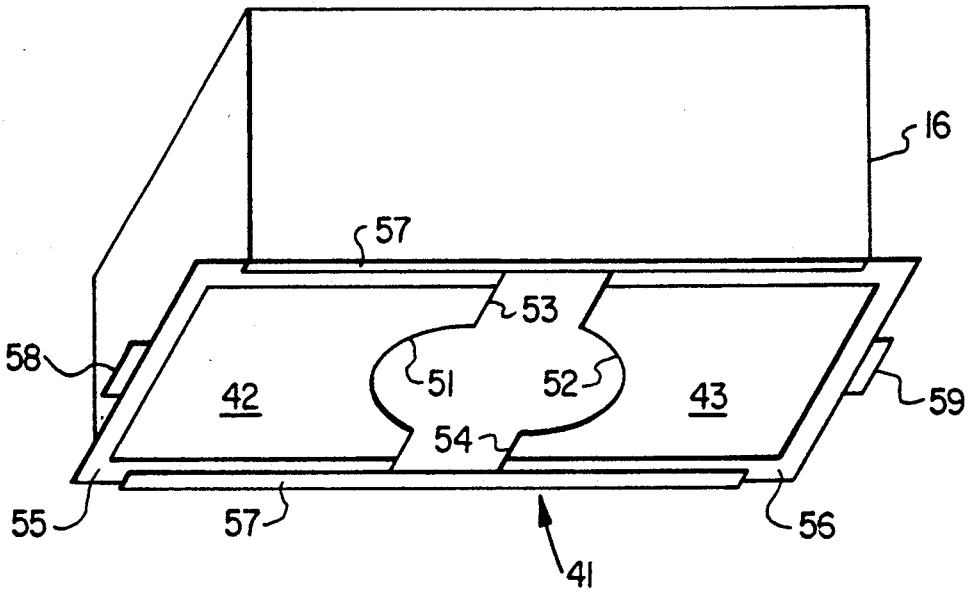
FIG. 5 is a perspective view of another embodiment of a head pressure adjusting valve.

FIG. 5 is a bottom-side perspective view Of the PCF of the present invention illustrating an alternative embodiment of the head pressure adjusting valve 41. Here it can be seen that the valve sections 42 and 43 of the head pressure adjusting valve 41 are constructed with semi-circular areas 51 and 52 cut out on the sides 53 and 54 which may be slidingly abutted. The valve sections 42 and 43 may be mounted in frames 55 and 56 which slide on a set of tracks 57 mounted on the bottom of the front and back sides of the housing 16. An elastomeric seal (not shown) such as, for example, a rubber strip, may be mounted on the bottom of the tracks 57 to form a vibration buffer and seal between the housing 16 and the existing air conditioning unit 12. Handles 58 and 59 may be mounted on the frames 55 and 56 to facilitate the positioning of the valve sections 42 and 43.

It is thus believed that the operation and construction of the present invention will be apparent from the foregoing description. While the method, apparatus and system shown and described has been characterized as being preferred, it will be readily apparent that various changes and modifications could be made therein without departing from the spirit and scope of the invention as defined in the following claims.

What is claimed is:

1. A portable condensing fan for temporarily cooling a condenser of an air conditioning unit having an air exhaust side with an exterior surface, and a unit condenser for said portable condensing fan comprising:

means for passing a flow of air over said condenser of said air conditioning unit by energizing said portable condensing fan in lieu of said unit condenser fan; and means for mounting said means for passing a flow of air on said exterior surface of said air exhaust side of said air conditioning unit.

2. The portable condensing fan of claim 1 wherein said means for passing a flow of air over said condenser includes a fan, said fan comprising:

an electric motor; and a fan blade attached to said motor.

3. The portable condensing fan of claim 2 wherein said means for passing a flow of air over said condenser includes a shroud which surrounds said fan blades of said fan and directs said flow of air over said condenser.

4. The portable condensing fan of claim 1 wherein said means for mounting said portable condensing fan on said exterior surface of said air exhaust side of said air conditioning unit includes:

a rigid housing for mounting said means for passing a flow of air therein; and anchoring members which secure said housing to said exterior surface of said exhaust side of said air conditioning unit.

5. The portable condensing fan of claim 4 wherein said rigid housing includes an elastomeric seal mounted on the bottom side of said housing and forming a vibration buffer and seal with said air conditioning unit.

6. The portable condensing fan of claim 1 further comprising a head pressure adjusting valve for maintaining an efficient head pressure on said portable condensing fan.

7. The temporary condensing fan of claim 6 wherein said head pressure adjusting valve includes:

two parallel tracks mounted on said means for mounting said temporary condensing fan, and positioned between said temporary condensing fan and said condenser; and two opposing valve sections slidably mounted on said tracks, said opposing valve sections having semi-circular ends which form a circular aperture when abuttingly contacted.

8. A temporary condensing fan for temporarily cooling a condenser of an air conditioning unit having an air exhaust side, said temporary condensing fan comprising:

means for passing a flow of air over said condenser of said air conditioning unit;

means for mounting said means for passing a flow of air on said air exhaust side of said air conditioning unit; and a head pressure adjusting valve for maintaining an efficient head pressure on said temporary condensing fan wherein said head pressure adjusting valve includes two elastomeric valve sections positioned between said housing and said air conditioning unit and forming a vibration buffer and seal therebetween.

9. A method of temporarily cooling a condenser of an air conditioning unit having an air exhaust side with an exterior surface, and a unit condenser fan, said method comprising the steps of:

motioning a portable condensing fan on said exterior surface of said air exhaust side of said air conditioning unit; and passing a flow of air over said condenser of said air conditioning unit by energizing said portable condensing fan in lieu of said unit condenser fan.

10. The method of claim 9 wherein the step of mounting said portable condensing fan at said air exhaust side of said air conditioning unit includes:

mounting said portable condensing fan within a rigid housing; and anchoring said housing to said exhaust side of said air conditioning unit.

11. The method of claim 10 further comprising the step of mounting an elastomeric seal on the bottom side of said housing to form an air-tight seal with said air conditioning unit.

12. The method of claim 9 wherein said step of passing a flow of air over said condenser includes providing a fan, said fan having an electric motor and a fan blade attached to said motor.

13. The method of claim 12 wherein said step of passing a flow of air over said condenser includes surrounding said fan blades of said fan with a shroud to direct said flow of air over said condenser.

14. The method of claim 9 further comprising the strep of maintaining an efficient head pressure on said condenser with a head pressure adjusting valve.

15. The method of claim 14 wherein said step of maintaining an efficient head pressure with a head pressure adjusting valve includes:

mounting two parallel tracks on said rigid housing between said temporary condensing fan and said condenser; and slidably mounting two opposing valve sections on said tracks, said opposing valve sections having semi-circular ends which form a circular aperture when abuttingly contacted.

16. A method of temporarily cooling a condenser of an air conditioning unit having an air exhaust side, said method comprising the steps of:

mourning a temporary condensing fan at said air exhaust side of said air conditioning unit;

passing a flow of air over said condenser of said air conditioning unit; and mainlining an efficient head pressure on said condenser with a head pressure adjusting valve, said step of maintaining an efficient head pressure including positioning two elastomeric valve sections between said housing and said air conditioning unit, thereby forming a vibration buffer and seal therebetween.

* * * * *

UNITED STATES PATENT AND TRADEMARK OFFICE

CERTIFICATE OF CORRECTION

PATENT NO. : 5,299,429
DATED : April 5, 1994
INVENTOR(S) : David Swink

It is certified that error appears in the above-indentified patent and that said Letters Patent is hereby corrected as shown below:

Column 3, line 43: Delete "temporary"; insert --portable--

Column 3, line 49: Delete the comma after "until"

Column 4, line 10: After "FIG.", insert --1.--

Column 4, line 12: Delete "TCF"; insert --PCF--

Column 4, line 67: Delete "Of"; insert --of--

Column 4, line 67: After "PCF", insert --11--

Column 5, line 25: Delete "for"; insert --fan--

Column 6, line 19: Delete "motioning"; insert --mounting--

Column 6, line 58: Delete "mourning"; insert --mounting--

Column 6, line 61: Delete "mainlining"; insert --maintaining--

Signed and Sealed this

Thirteenth Day of September, 1994

*Attest:*

*Attesting Officer*

Bruce Lehman

BRUCE LEHMAN

*Commissioner of Patents and Trademarks*